US006198433B1

(12) United States Patent
Herault et al.

(10) Patent No.: US 6,198,433 B1
(45) Date of Patent: Mar. 6, 2001

(54) MULTIPLE-BEAM ELECTRONIC SCANNING ANTENNA

(75) Inventors: Joël Herault, Igny; Michel Soiron, Chavenay; Gérard Garnier, Gig sur Yvette, all of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/296,740

(22) Filed: Apr. 23, 1999

(30) Foreign Application Priority Data

Apr. 24, 1998 (FR) ..... 98 05182

(51) Int. Cl.[7] ..... H01Q 3/22; H01Q 3/24; H01Q 3/26

(52) U.S. Cl. ..... 342/372; 342/376; 342/157

(58) Field of Search ..... 342/372, 157, 342/154, 158, 376

(56) References Cited

U.S. PATENT DOCUMENTS 4,314,250 * 2/1982 Hanell et al. .
4,612,547 * 9/1986 Itoh ..... 342/372
4,980,691 * 12/1990 Rigg et al. ..... 342/372
5,706,012 1/1998 Kay ..... 342/156

OTHER PUBLICATIONS

Y. J. Guo, et al., IEEE Proceedings: Microwaves, Antennas and Propagation, vol. 142, No. 2, pp. 115–120, "Phase Efficiency of the Reflective Array Antenna", Apr. 1, 1995.
E. Hecht, pp. 493–494, "Optics", 1987.
Shiban K. Koul, Artech House, vol. 1, pp. 47–53, "Microwave and Millimeter Wave Phase Shifters", 1991.
Bernard Grob, Mc Graw Hill, pp. 592–593, "Grob Basic Electronics", 1992.
R. D. Javor, et al., vol. 2, pp. 956–959, "Beam Steering of Microstrip Flat Reflectarray Antenna", Jun. 19, 1994.

* cited by examiner

*Primary Examiner*—Theodore M. Blum
(74) *Attorney, Agent, or Firm*—Oblon, Spivak, McClelland, Maier & Neustadt, P.C.

(57) ABSTRACT

A multiple-beam electronic scanning antenna including an array of phase-shifters (2, $D_{ij}$). The N simultaneous beams are obtained in N directions by a law of excitation ($f_{ij}$) applied to each computed phase-shifter ($D_{ij}$) by summing the phase laws $\psi_1, \psi_2, \ldots \psi_k, \ldots \psi_N$ associated respectively with each 1, 2, . . . k, . . . N order direction and by applying the resultant phase-shift ($\psi t_{ij}$) to the phase-shifter, without applying the resultant amplitude modulation ($\rho_{ij}$). The multiple-beam electronic scanning antenna especially is applicable to uniquely phase-controlled antennas in satellite or terrestrial communications requiring simultaneous communications with several variable sites.

10 Claims, 1 Drawing Sheet

MULTIPLE-BEAM ELECTRONIC SCANNING ANTENNA

BACKGROUND OF THE INVENTION

1. Field of the Invention

The present invention relates to a multiple-beam electronic scanning antenna. It can be applied especially to uniquely phase-controlled antennas for example in the context of satellite or terrestrial communications requiring simultaneous communications with several variable sites.

2. Discussion of the Background

Telecommunication requirements are constantly on the increase. Furthermore, military, civilian, professional and private users are demanding ever lower costs. To meet these demands, telecommunication equipment has to be very economical. To this end, it is worthwhile to use multiple-beam antennas which enable simultaneous transmission and reception in several different directions which, furthermore, are not fixed in advance. Thus, it is advantageous for a communications satellite to be capable of communicating simultaneously, by means of one and the same antenna, with several stations that are variable in number and position. This is also the case with terrestrial radiocommunications for example where several mobile sites belonging to one and the same network can communicate with one another simultaneously.

There are known ways of making multiple-beam electronic scanning antennas, but these antennas are active, i.e. they comprise not just phase-shifters but active modules that can be controlled in phase but also in amplitude modulation, more particularly in modulation of the power emitted per module. Now, an active module antenna is costly.

SUMMARY OF THE INVENTION

The invention enables the making of a multiple-beam electronic scanning antenna not provided with active modules, i.e. a uniquely phase-controlled antenna, as an antenna of this kind is more economical. To this end, an object of the invention is an electronic scanning antenna comprising an array of phase-shifters $D_{ij}$ wherein N simultaneous beams are obtained in N independent directions by a law of excitation $f_{ij}$ applied to each phase-shifter $D_{ij}$ that is computed by summing the phase laws $\psi_1, \psi_2, \ldots \psi_k, \ldots \psi_N$ associated respectively with each 1, 2, . . . k, . . . N order direction according to the relationship:

$$f_{ij}=e^{j\psi_1}+e^{j\psi_2} \ldots +e^{j\psi_k} \ldots +e^{j\psi_N}=\rho_{ij}e^{j\psi_{tij}}$$

and by applying the resultant phase-shift $\psi t_{ij}$ to the phase-shifter, without applying the resultant amplitude modulation $\rho_{ij}$.

The main advantages of the invention are that it can be adapted to already constructed antennas, is applicable to all types of electronic scanning antennas, enables the creation of a large number of beams simultaneously for one and the same antenna and is simple to implement.

BRIEF DESCRIPTION OF THE DRAWINGS

Other features and advantages of the invention shall appear from the following description made with reference to the appended drawings, of which.

DESCRIPTION OF THE PREFERRED EMBODIMENTS

Figure 1:
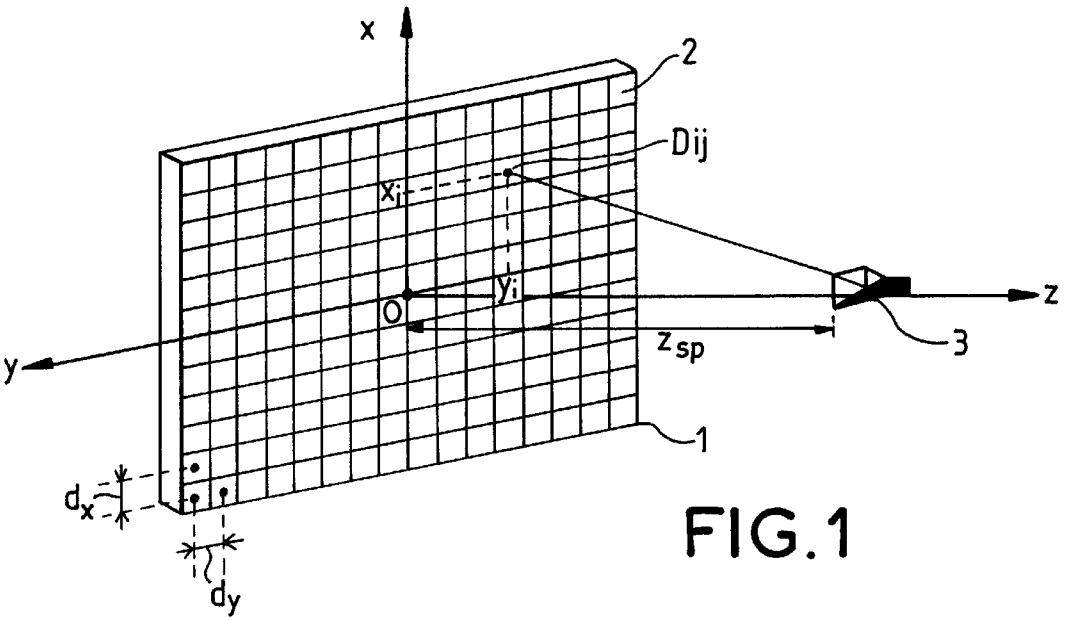
FIG. 1 exemplifies an electronic scanning reflector antenna in which the invention can be applied.

Referring now the drawings, wherein like reference numerals designate identical or corresponding parts throughtout the several views, and more particularly to FIG. 1 thereof, there is illustrated an exemplary electronic scanning antenna of the present invention, comprising a reflector. In this type of antenna, a primary source illuminates the reflector which focuses the energy received in a desired direction, the variation of direction being obtained by a command from the reflector. The reflector 1 comprises for example an array of N×M elementary phase-shifters 2, more particularly, N phase-shifters along a first axis x and M phase-shifters along a second axis y which is, for example, orthogonal to the first axis. The antenna is for example a phase-controlled antenna, i.e. there is no amplitude control. The reflector 1 of the antenna is illuminated by a radiating element 3. This radiating element is for example a horn powered by a primary source in a manner known to those skilled in the art. It is placed at a distance $z_{sp}$ from the reflector. If we look at the starting point of the phase, for example at the geometrical center O of the plane of the reflector, which is, for example, also the starting point of the two above-mentioned axes x, y, the theoretical phase law $\Psi$ to be applied to a phase-shifter $D_{ij}$ to aim an obtained transmission beam in a scanning direction $(\theta_b, \phi_b)$ is written according to the following relationships:

$$\Psi=\Psi_x+\Psi_y \tag{1}$$

whatever the distance between the phase-shifters with especially, in the event of equidistance between these phase-shifters:

$$\Psi_{xi} = 2\pi i\frac{d_x}{\lambda}\sin\theta_b\cos\varphi_b \tag{2}$$

and $$\Psi_{yi} = 2\pi j\frac{d_y}{\lambda}\sin\theta_b\sin\varphi_b \tag{3}$$

where:

- $D_{ij}$ is the i order phase-shifter along the axis x and the j order phase-shifter along the axis y, i and j being relative integers such that two phase-shifters positioned on one and the same straight line that is parallel to one of the two axes x, y but has its segment intersected by one of these two axes, which pass through the starting point O, have opposite orders of signs;
- $d_x$ and $d_y$ are respectively the distances along the axes x and y, between the centers of two contiguous phase-shifters;
- z being the axis perpendicular to the two preceding axes x, y, $\theta_b$ is the angle of the direction of aim of the beam seen from the starting point O, with respect to the axis z, in the plane O, x, z and $\phi_b$ is the angle of the projection on the plane O, x, y of the direction of aim of the beam seen from the starting point O, with respect to the axis x, in the plane O, y, y, in other words, $\theta_b$ is the angle between the scanning direction and the axis Oz and $\phi_b$ is the angle between the scanning direction projected in the plane O, x, y and the axis Ox;
- $\lambda$ is the transmitted wavelength.

To this theoretical phase $\Psi$, it is necessary to add the phase opposite to the phase of the radiation of the primary source of the radiating element 3 which illuminates the reflector 1, to focus the energy in the desired scanning direction ($\theta_b$, $\phi_b$). In the case of a primary source, located at the distance $z_{sp}$ mentioned here above, $z_{sp}$ being actually the coordinates of a point representing this source in the reference system O, x, y, z defined here above, we get, with $\Psi_{sp}$ denoting the radiation phase of the primary source 3:

$$\Psi_{sp_{ij}} = 2\pi\frac{\sqrt{(x_i^2 + y_j^2 + z_{sp}^2}}{\lambda} \tag{4}$$

where $x_i$ and $y_j$ are the coordinates of the center of the phase-shifter in the plane O, x, y.

The relationship (4) shows that this phase $\Psi_{sp_{ij}}$ pertains to a spherical wave. It is also necessary to take account of the phase $\Psi_0$ of the horn of the radiating source that can be chosen on an a priori basis.

Thus, the theoretical excitation $f_{ij}(x, y)$ associated with a phase-shifter $D_{ij}$ to form a lobe in a given direction ($\theta_b$, $\phi_b$) is given by the following relationship:

$$f_{ij}(x,y)=e^{j(\Psi_{xi}+\Psi_{yj}-\Psi_{spij}+\Psi_0)} \tag{5}$$

In practice, since the phase-shifters are for example controlled in N bits, the true phase applied to a phase-shifter $D_{ij}$ is the phase $\Psi tq_{ij}$ quantified at the step of the phase-shifter $q=2\pi/2^N$. Taking $\Psi t_{ij}$ to denote the total phase equal to $\Psi_{xi}+\Psi_{yj}-\Psi_{sp_{ij}}+\Psi_0$, we get:

$$\Psi tq_{ij}=E(\Psi t_{ij}/q)\times q \tag{6}$$

where $E(\Psi t_{ij}/q)$ is the integer part of $\Psi t_{ij}/q$, q being equal to $2\pi/2^N$.

To illustrate the multiple-beam operation, an exemplary transmission of two beams at the same frequencies is first of all presented, the two beams being directed in directions ($\theta_{b1}$, $\phi_{b1}$) and ($\theta_{b2}$, $\phi_{b2}$) defined with the same conventions as above for the direction ($\theta_b$, $\phi_b$). In accordance with the relationships (1) to (3), the phases $\Psi_{b1}$ and $\Psi_{b2}$ associated with these two directions are given by the following relationships:

$$\Psi_{b1} = 2\pi\left(i\frac{dx}{\lambda}\sin\theta_{b1}\cos\varphi_{b1} + j\frac{dy}{\lambda}\sin\theta_{b1}\sin\varphi_{b1}\right) \tag{7}$$

$$\Psi_{b2} = 2\pi\left(i\frac{dx}{\lambda}\sin\theta_{b2}\cos\varphi_{b2} + j\frac{dy}{\lambda}\sin\theta_{b2}\sin\varphi_{b2}\right) \tag{8}$$

In taking account of the phase $-\Psi_{sp_{ij}}$ of focusing of the plane array which is actually used, as shown here above, to compensate for the phase of the spherical wave of the primary source 3 of the reflector which is assumed to be a pinpoint source, and in taking account of the original phase of the horn, the theoretical excitation $f_{ij}$ associated with a phase-shifter $D_{ij}$ verifies the following relationship:

$$f_{ij}=e^{j(\Psi_{b1}-\Psi_{spij}+\Psi_{01})}+e^{j(\Psi_{b2}-\Psi_{spij}+\Psi_{02})}=e^{j\Psi_1}+e^{j\Psi_2} \tag{9}$$

in noting one phase at the origin of the horn for each independent direction, respectively $\Psi_{01}$, $\Psi_{02}$ for the first and second directions.

By application of the above relationships (7), (8) and (9) the excitation $f_{ij}$ may also be written according to the following relationship:

$$f_{ij} = 2\cos\frac{\Psi_1 - \Psi_2}{2}e^{j\Psi_1+\frac{\Psi_2}{2}} = \rho_{ij}e^{j\Psi t_{ij}} \tag{10}$$

-continued or $$\psi_1 = \psi_{b1} - \Psi_{sp_{ij}} + \psi_{01}$$

and $$\psi_2 = \psi_{b2} - \Psi_{sp_{ij}} + \psi_{02}$$

with $$\rho_{ij} = 2\left|\cos\Psi_1 - \frac{\Psi_2}{2}\right|$$

and:

$$\Psi t_{ij} = \frac{\Psi_1 + \Psi_2}{2}$$

if $$-\frac{\pi}{2} + 2k\pi \le \frac{\Psi_1 - \Psi_2}{2} \le \frac{\pi}{2} + 2k\pi$$

or:

$$\Psi t_{ij} = \frac{\Psi_1 + \Psi_2}{2} + \pi$$

if $$\frac{\pi}{2} + 2k\pi \le \frac{\Psi_1 - \Psi_2}{2} \le \frac{3\pi}{2} + 2k\pi$$

The phase law to be applied to the phase-shifters of the antenna, to form the two beams, is the quantified phase:

$$\Psi tq_{ij}=E(\Psi t_{ij}/q)\times q \tag{11}$$

Thus, according to the relationship (10), to form several beams, it is not enough to apply the linear phase law $$\frac{\Psi_1 + \Psi_2}{2},$$

but it is also necessary modulate the amplitude of the phase-shifters according to the law:

$$A_{ij} = 2\cos\frac{\Psi_1 - \Psi_2}{2} \tag{12}$$

for each phase-shifter $D_{ij}$, this amplitude modulation being especially a function of the situation of each phase-shifter $D_{ij}$ and of the wavelength $\lambda$ as can be seen especially from the relationships (7), (8) and (12).

Now, in the case of a uniquely phase-controlled antenna, it is not possible to act on the amplitude. In the case, for example, of the formation of two beams, the invention makes it possible to obtain an approximation of the sinusoidal amplitude according to the relationship (12) in an amplitude modulation with two states +1 and −1. This actually means taking a modulus $\rho_{ij}=|A_{ij}|$ equal to 1 and adding a phase-shift by $\pi$ to the phase when the amplitude changes its sign. As a result, there is no amplitude modulation. An antenna with phase-shifter only may therefore be used.

Figure 2:
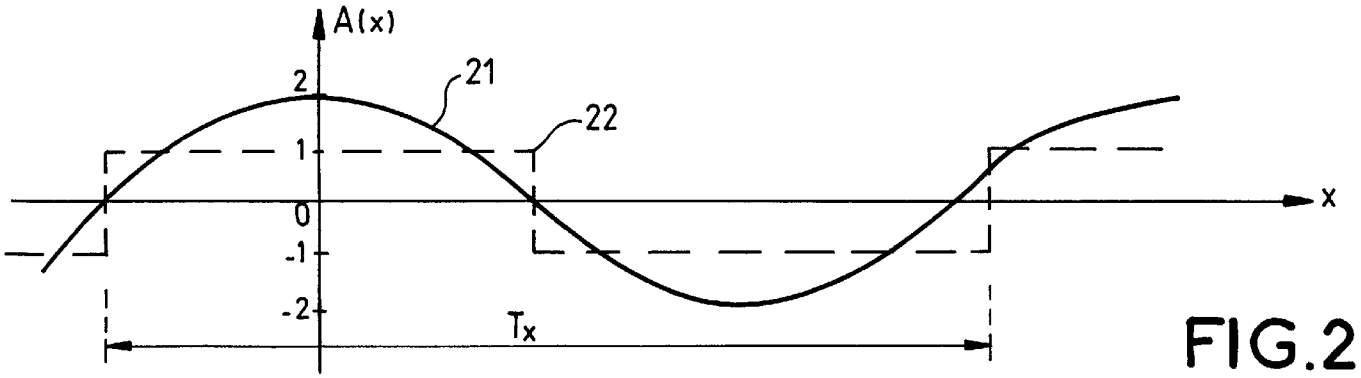
FIG. 2 provides an approximation of an amplitude modulation by a two-state modulation in the case of a two-beam antenna.

FIG. 2 illustrates an approximation of this kind in the case of the formation of two beams in directions $\theta_1$, $\theta_2$ taken in the plane Oxz defined here above. The ordinate axis represents homogeneous values A(x) with an amplitude modulation as a function of the coordinates taken on the axis x. A first sine curve 21 represents the amplitude modulation A(x) to be applied according to the relationship (12). For x=0, the function A(x) is the maximum and equal to 2 when $\Psi_1=\Psi_2$, according to the relationship (12). This is verified when the phases at the origin of the horns, should these horns be used, are identical. The period of variation Tx is given by the following relationship:

$$Tx = \frac{2\lambda}{\sin\theta_1 - \sin\theta_2} \tag{13}$$

The amplitude modulation as represented by the curve 21 is approached, according to the invention, by an amplitude modulation with two states, 1 and −1, represented by a curve 22. This two-state modulation has the same period of variation Tx as the above sinusoidal modulation. It also has the same sign. In other words, when the function A(x) is positive, the approximation function is equal to 1, and when the function A(x) is negative, the approximation function is equal to −1. It must be noted that the function of approximation of the sinusoidal phase modulation A(x) has the same period Tx as this sinusoidal phase modulation itself. This makes it possible especially to preserve the information pertaining to the directions aimed at, contained in the period Tx, and makes it possible to cause no loss of gain.

To form N beams at the same frequency in N independent directions, it is enough to quantify or not quantify the phase deduced from the expression of the excitation $f_{ij}$ linked to the phase-shifters and defined by the following relationship, for a phase-shifter $D_{ij}$:

$$f_{ij}=e^{j\Psi_1}+e^{j\Psi_2}\ldots+e^{j\Psi_k}\ldots+e^{j\Psi_N}=\rho_{ij}e^{j\Psi t_{ij}} \tag{14}$$

where $\Psi_1, \Psi_2, \ldots \Psi_k, \ldots \Psi_N$ respectively represent the phases associated with the first, second, $k^{th}$ and $N^{th}$ directions, the quantified phase law being always $\Psi tq_{ij}=E(\Psi t_{ij}/q)\times q$.

By extrapolation of the two-beam case, the experiments conducted by the Applicant have indeed shown that only the phase-shift $\Psi t_{ij}$ may be applied, without applying the amplitude modulation $\rho_{ij}$, namely in taking $\rho_{ij}=1$. In other words, according to the invention, the law of excitation $f_{ij}$ applied to each phase-shifter $D_{ij}$ is computed by summing the phases laws $\psi_1, \psi_2, \ldots \psi_k, \ldots \psi_N$ associated respectively with each 1, 2, . . . k, . . . N order direction, according to the previous relationship (14) and by applying the resultant phase-shift $\psi t_{ij}$ to the phase-shifter, without applying the resultant amplitude modulation $\rho_{ij}$.

To form N beams at N different frequencies, it is enough to quantify or not quantify the phase deduced from the relationship (14) but with a phase $\Psi k$, associated with a $k^{th}$ direction which, in relation to a phase-shifter $D_{ij}$, verifies the following relationship (15):

$$\Psi_k = 2\pi\left(i\frac{dx}{\lambda_k}\sin\theta b_k\cos\varphi b_k + j\frac{dy}{\lambda_k}\sin\theta b_k\sin\varphi b_k\right) - 2\pi\frac{r_{ij}}{\lambda_k} + \Psi_{0k}$$

where $\lambda_k$ represents the wavelength associated with the $k^{th}$ beam or k order beam.

$$-2\pi\frac{r_{ij}}{\lambda_k} + \Psi_{0k}$$

is a corrective term that can be applied only in the case of a reflector antenna according to FIG. 1 for example, where $\Psi_{Ok}$ can be applied to any antenna. Given that the reflector 1 is plane and that the radiation emitted by the source is spherical, it is necessary to take account of the fact that all the phase-shifters do not receive this radiation at the same time. It is the term $$-2\pi\frac{r_{ij}}{\lambda_k}$$

that represents the delay related to the phase-shifter $D_{ij}$ and corresponds in fact to the phase-shift $\Psi_{sp_{ij}}$ of the previous relationship (4), where $r_{ij}$ is the distance from the source 3 to the phase-shifter $D_{ij}$ of the plane reflector. $\Psi_{Ok}$ represents the phase of the radiation emitted, at the starting point O of the reflector plane, and corresponds to the phase-shift $\psi_O$ of the relationship (5).

The quantified phase to be applied to the phase-shifter remains the phase $\Psi tq_{ij}=E(\Psi t_{ij}/q)\times q$.

To obtain beams with given directions and characteristics, it is possible to associate a weighting coefficient $r_k$ with each k order lobe or beam. According to the invention, this coefficient is used for the determination of the phase law applied to a phase-shifter $D_{ij}$, but, as here above, the resulting modulation is not actually applied since there is no amplitude modulation at the level of the phase-shifters. The experiments made by the Applicant have indeed shown that several beams could be obtained from the phase law computed in this way for each phase-shifter, without applying the amplitude modulation.

The law of excitation $f_{ij}$ of a phase-shifter is then determined according to the following relationship:

$$f_{ij}=r_1e^{j\Psi_1}+r_2e^{j\Psi_2}\ldots+r_ke^{j\Psi_k}\ldots+r_Ne^{j\Psi_N}=\rho_{ij}e^{j\Psi t_{ij}} \tag{16}$$

but in reality, it is the excitation $f_{ij}'=e^{j\Psi t_{ij}}$ that is applied, the quantified phase law being always $\Psi tq_{ij}=E(\Psi t_{ij}/q)\times q$.

A possible application is, for example, the formation of a difference channel in one direction and a sum channel in another direction to perform, in particular, a removal of angular ambiguity. In this case, the scanning could be done in the plane Ox, Oz as defined here above, in a direction $\theta_1$ for the difference channel and a direction $\theta_2$ for the sum channel. If, for example, the antenna is not a reflector antenna, i.e. especially if the phase-shifts $\psi_{sp}$ and $\psi_0$ are zero, and by application of the relationships (7) and (8), we get, for the phase relationships $\psi_1$ and $\psi_2$:

$$\Psi_1 = 2\pi\frac{idx}{\lambda}\sin\theta_1$$

and $$\Psi_2 = 2\pi\frac{idx}{\lambda}\sin\theta_2$$

and, according to the relationship (16):

$$f_{ij}=r_1e^{j\Psi_1}+r_2e^{j\Psi_2}$$

The above coefficients $r_1$ and $r_2$ may then be given by the following relationships:

$$r_1 = 2\pi\frac{idx}{\lambda}\cos\theta_1 \tag{17}$$

-continued $$r_2 = \left[\frac{1}{NM}\sum_i^N\sum_j^M\left(2\pi\frac{idx}{\lambda}\cos\theta_1\right)^2\right]^{1/2} \quad (18)$$

$r_2$ being a coefficient of standardization that enables the emission of the same power in both directions and $r_1$ being a coefficient that makes it possible to obtain a difference channel in the first direction, $r_1$ being in fact equal to $$\frac{\partial\Psi_1}{\partial\theta_1}.$$

FIG. 1 shows an application with a reflector antenna, but it is of course possible to apply the invention to all types of solely phase-controlled electronic scanning antennas, with or without active modules. Furthermore, the invention may be applied a fortiori to antennas that are, in addition, amplitude-controllable antennas. Nor is it necessary for the array of phase-shifters to be plane.

For example, reference has been made to discrete N-bit phase-shifters but the invention can also be applied to continuously controlled phase-shifters. The invention can be adapted to already constructed antennas since they act only on the phase laws applied to the phase-shifters of the antennas. Nor is it necessary to carry out operations of physical adaptation. This means that the invention is simple to implement. It is enough simply to integrate the laws computed according to the invention into the control means of the phase-shifters. It is furthermore possible to create a large number of beams simultaneously, for example up to several tens of beams, especially if the number of phase-shifters is great, with or without different frequencies.

An exemplary embodiment of the invention has been presented for a single-source reflector antenna, constituted in particular by a horn. The invention however may be applied to a reflector antenna with several sources, in associating, for example, one or two directions per primary source.

Numerous modifications and variations of the present invention are possible in light of the above teachings. It is therefore to be understood that within the scope of the appended claims, the invention may be practiced otherwise than as specifically described herein.

What is claimed is:

1. An electronic scanning antenna comprising:

an array of phase-shifters $D_{ij}$, wherein N simultaneous beams are obtained in N independent directions by:

(i) a law of excitation $f_{ij}$ applied to each phase-shifter $D_{ij}$ that is computed by summing phase laws $\psi_1, \psi_2, \ldots \psi_k, \ldots \psi_N$ associated respectively with each 1, 2, . . . k, . . . N order direction according to the following relationship:

$$f_{ij}=e^{j\Psi_1}+e^{j\Psi_2}\ldots+e^{j\Psi_k}\ldots+e^{j\Psi_N}=\rho_{ij}e^{j\Psi t_{ij}}$$

and (ii) by applying a resultant phase-shift $\psi t_{ij}$ to the phase-shifter, without applying a resultant amplitude modulation $\rho_{ij}$.

2. The antenna according to the claim 1, wherein frequencies of the beams are different.

3. The antenna according to claim 1, wherein the phase laws $\psi_1, \psi_2, \ldots \psi_k, \ldots \psi_N$ are assigned respective weighting coefficients ($r_1, r_2, \ldots r_k, \ldots r_N$).

4. The antenna according to claim 3, wherein the weighting coefficients are determined to obtain a sum channel and a difference channel according to two different directions.

5. The antenna according to claim 4, wherein the weighting coefficient $r_1$ associated with the first phase law $\psi_1$ satisfies the relationship:

$$r_1 = \frac{\partial\Psi_1}{\partial\theta_1}$$

and a coefficient of standardization associated with the second phase law $\psi_2$ is a coefficient of standardization that enables emitting of a same power in both of the two different directions.

6. The antenna according claim 1, wherein the number N of the beams is equal to two, the amplitude modulation A(x) computed is approximated by a two-state modulation, the approximate modulation changing a state thereof when the computed modulation A(x) changes a sign thereof.

7. The antenna according to claim 6, wherein an additional phase-shift by $\pi$ is applied to a phase-shifter when the computed modulation A(x) changes a sign thereof.

8. The antenna according to claim 1 wherein, with the phase-shifters being controlled in N bits, a phase applied to a phase-shifter ($D_{ij}$) is given by:

$$\Psi tq_{ij}=E(\Psi t_{ij}/q)\times q$$

where $E(\Psi t_{ij}/q)$ is an integer part of $\Psi t_{ij}$, q is equal to $2\pi/2^N$ and $\Psi t_{ij}$ is the resultant phase-shift.

9. The antenna according to claim 1, comprising a reflector including the array of phase-shifters.

10. An antenna satisfying the following relationship:

$$\Psi tq_{ij}=E(\Psi t_{ij}/q)\times q$$

where $E(\Psi t_{ij}/q)$ is an integer part of $\Psi t_{ij}/q$, being equal to $2\pi/2^N$ and $\Psi t_{ij}$ is a resultant phase-shift, wherein phase laws $\psi_1$, $\psi_2$ associated respectively with a difference channel and a sum channel are given by the following relationships:

$$\Psi_1 = 2\pi\frac{idx}{\lambda}\sin\theta_1$$

and $$\Psi_2 = 2\pi\frac{idx}{\lambda}\sin\theta_2$$

associated weighting coefficients are respectively:

$$r_1 = 2\pi\frac{idx}{\lambda}\cos\theta_1$$

and $$r_2 = \left[\frac{1}{NM}\sum_i^N\sum_j^M\left(2\pi\frac{idx}{\lambda}\cos\theta_1\right)^2\right]^{1/2}$$

where $\theta_1$, $\theta_2$ are angles of two directions in relation to an axis (Ox) taken in a common plane (Oxz) thereof, idx is a coordinate of a phase-shifter $D_{ij}$ taken on the axis (Ox) and $\lambda$ is a wavelength of a beam of the difference channel.

* * * * *